US005713142A

United States Patent [19]

Ahmed Fahmey El-Circy

[11] Patent Number: 5,713,142

[45] Date of Patent: Feb. 3, 1998

[54] TRAINING SHOES HAVING A SOLE MOUNTED ELASTIC MEMBER

[76] Inventor: Mohmed Osama Ahmed Fahmey El-Circy, P.O. Box 9229, Dubai, United Arab Emirates

[21] Appl. No.: 739,793

[22] Filed: Oct. 30, 1996

[30] Foreign Application Priority Data

Oct. 30, 1995 [GB] United Kingdom ..... 9522153

[51] Int. Cl.[6] ..... A43B 5/00; A63B 21/02

[52] U.S. Cl. ..... 36/132; 482/125; 36/131

[58] Field of Search ..... 36/131, 132, 136, 36/1; 482/79, 124, 125

[56] References Cited

U.S. PATENT DOCUMENTS

| | | | |
|---|---|---|---|
| 2,160,722 | 5/1939 | Cunningham | 482/125 X |
| 4,361,972 | 12/1982 | Miller | 36/131 |
| 4,596,387 | 6/1986 | Roberts | 272/93 |
| 4,685,351 | 8/1987 | Pegg | 36/131 X |
| 5,224,913 | 7/1993 | Rodibaugh | 482/324 |
| 5,263,916 | 11/1993 | Bobich | 482/124 |
| 5,306,222 | 4/1994 | Wilkinson | 482/125 X |
| 5,535,531 | 7/1996 | Karabed et al. | 36/136 X |
| 5,545,113 | 8/1996 | Bobich | 482/125 |

FOREIGN PATENT DOCUMENTS

| | | |
|---|---|---|
| 1417482 | 1/1973 | United Kingdom . |
| WO8403206 | 2/1983 | WIPO . |

*Primary Examiner*—B. Dayoan
*Attorney, Agent, or Firm*—Oppenheimer Poms Smith

[57] ABSTRACT

A training shoe includes an anchorage device (3) adapted secure to receive one or more elastic cords (5) against which a wearer may exert him or herself. Preferably, the anchorage device includes a hole (3) extending transversely through the sole (1) of the shoe and through which hole (3) one or more elastic cords (5) are threaded so as to form an elastic loop which may be pulled by the wearer as part of an exercise regime.

10 Claims, 3 Drawing Sheets

TRAINING SHOES HAVING A SOLE MOUNTED ELASTIC MEMBER

FIELD OF THE INVENTION

This invention relates to training shoes, and in particular to a training shoe adapted to be used as part of an exercise regime involving exertion against one or more elastic members.

PRIOR ART

Personal training devices comprising one or more elastic members against which a person may exert him or herself are well-known. One such device is made up of elastic bands provided with loops adapted to receive the feet and hands of a person, thereby allowing work to be done against the elastic bands when these are stretched. However, the loops adapted to receive the feet are uncomfortable and can easily slip off the soles of the feet, which is potentially dangerous particularly when the elastic bands are stretched.

SUMMARY OF THE INVENTION

According to the present invention, there is provided an exercise device comprising at least one shoe and at least one elongate elastic member, the at least one shoe including an upper and a sole portion, wherein the sole portion is provided with anchorage means, and wherein the at least one elongate elastic member may be attached to the anchorage means and, in use, gripped by a wearer of the device so as to provide an elastic force against which the wearer may exert him or herself.

The anchorage means may comprise eyelet hooks or similar devices located on the exterior of the shoe, but in a particularly preferred embodiment, the anchorage means comprises a hole passing transversely through the sole of the training shoe, through which hole an elongate elastic member may be passed. By providing a firm anchorage for the elastic member, the risk of slippage is substantially eliminated, thereby improving the safety and efficiency of the exercise regime.

The hole is preferably located in the region of the instep of the shoe, and is preferably lined with a tube which is rigid relative to the material of the sole of the shoe so as to avoid undue flexing of the sole when the elastic members are stretched.

Alternatively, each end of the hole may be provided with a screw thread or similar means allowing an elongate elastic member provided with a complementary screw thread or the like to be securely anchored at one or both ends of the hole. Where such anchorage means are used, it is not necessary for a hole to extend through the sole of the shoe, although it is preferred that a rigid connecting member be provided to connect the anchorage means on either side of the sole to each other so as to reduce flexing.

Advantageously, the anchorage points on either side of the sole of the shoe may, when not in use, be covered with caps so as to allow the shoe to be used without the elastic members as a normal training shoe. Because the shoe is so readily adaptable, it is possible for a person to undertake various forms of exercise without the need to put on different shoes each time a new exercise is attempted.

The elongate elastic members may be fabricated from any suitable elastic material, and are preferably in the form of an elastic cord. In embodiments of the invention where there is provided a hole which passes through the sole of the training shoe, the cord may be threaded through the hole and the two free ends connected by way of connecting means so as to form an elastic loop which the wearer may pull with his or her hands as an exercise. Alternatively, where the anchorage points comprise screw-threaded recesses or the like, the elastic cord may be provided at each end with a complementary screw-threaded or similar connecting member which may be secured in the recesses so as to form an elastic loop. Advantageously, so as to allow the elastic resistance to be varied, two or more elastic cords may be secured to each anchorage point. This enables the difficulty of the exercise regime to be increased as the strength and fitness of the wearer increases. Alternatively or in addition, the two limbs of the elastic loop may be brought together and connected by way of a slidable clip. By sliding the clip up and down, the elastic resistance may respectively be decreased and increased.

BRIEF DESCRIPTION OF THE DRAWING

For a better understanding of the present invention and to show how it may be carried into effect, reference shall now be made to the accompanying drawings, in which.

DETAILED DESCRIPTION OF THE PREFERRED EMBODIMENT

Figure 1:
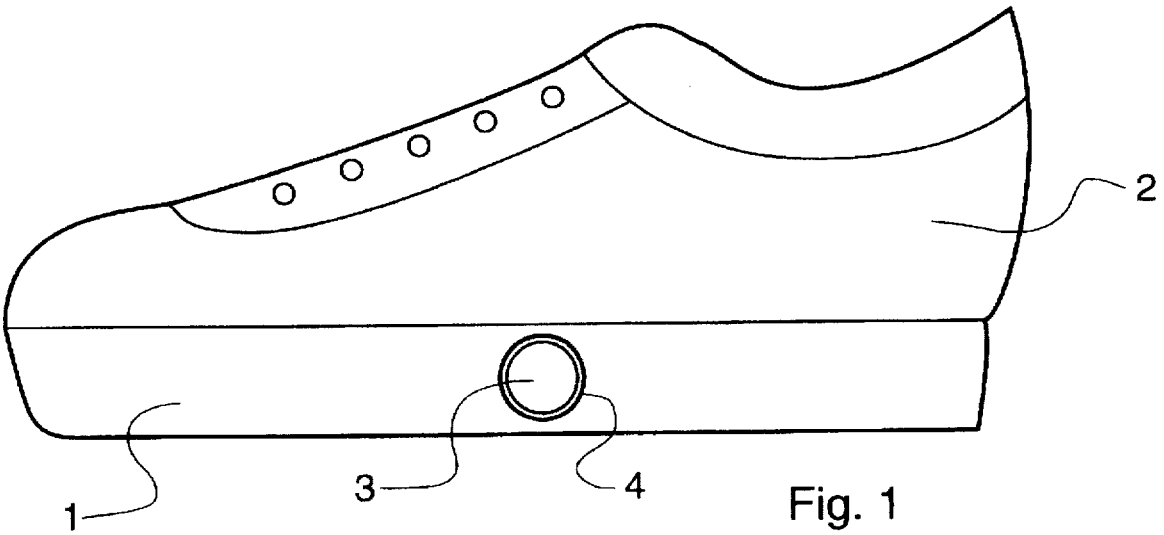
FIG. 1 shows a side elevation of a preferred embodiment of a shoe according to the invention.
Figure 5:
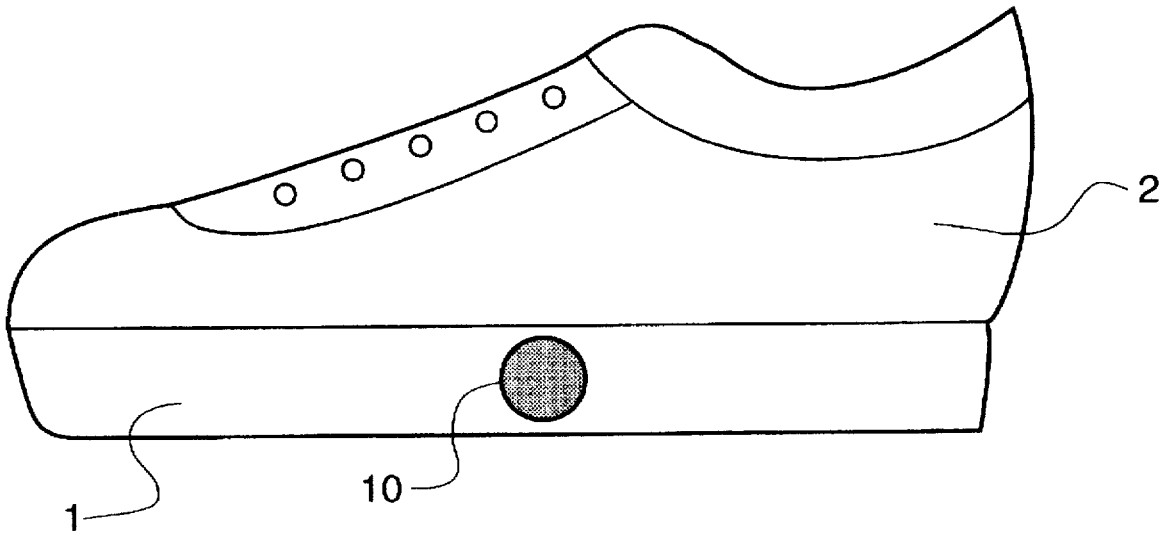
FIG. 5 shows the shoe of FIG. 1 with the caps in place.

The shoe shown in FIG. 1 comprises a sole 1 and an upper 2. The sole 1 is provided with a hole 3 which extends through the width of the sole 1, and is lined with a relatively rigid tube 4. Each end of the hole 3 may be covered with a cap 10 (FIG. 5 ) when the shoe is being worn normally.

Figure 2:
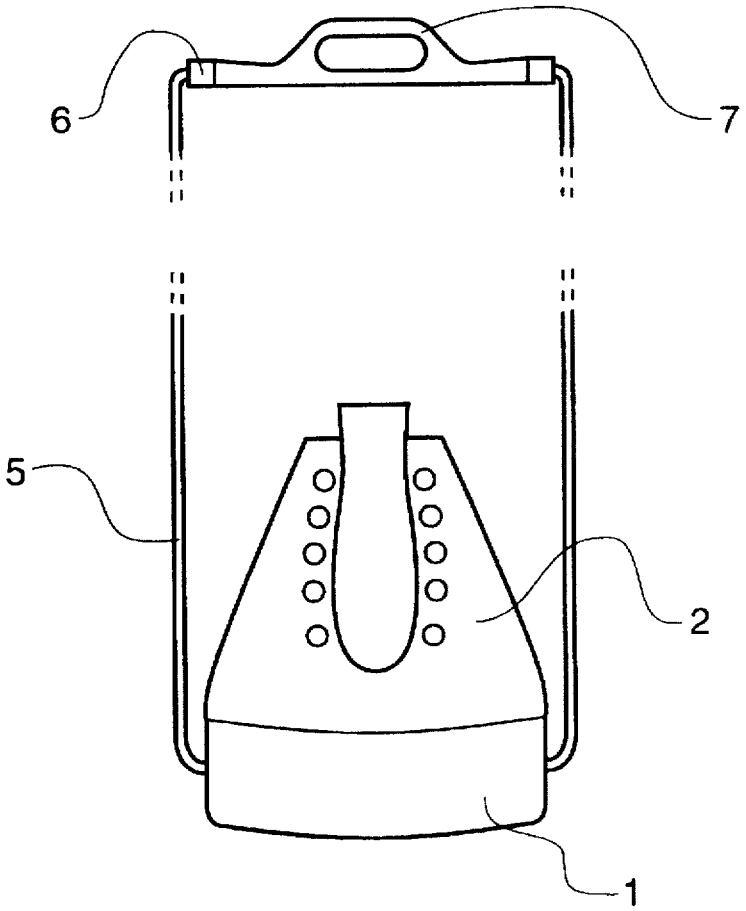
FIG. 2 shows the shoe of FIG. 1 fitted with an elastic cord.

FIG. 2 shows the shoe of FIG. 1 fitted with an elastic cord 5. The elastic cord 5 is threaded through the hole 3, and each end of the cord 5 is provided with a screw-threaded connector 6 which may be screwed into a handle 7. The length of the cord 5 is generally such that the handle 7 may be comfortably held by the wearer of the shoe when standing upright with his or her arms lowered. A variety of exercise regimes may then be undertaken whereby the wearer raises his or her arms against the resistance of the elastic cord 5 without danger of the cord 5 slipping from its anchorage. In order to provide increased resistance and an accordingly more vigorous exercise regime, more than one elastic cord 5 may be threaded through the hole 3.

Figure 3:
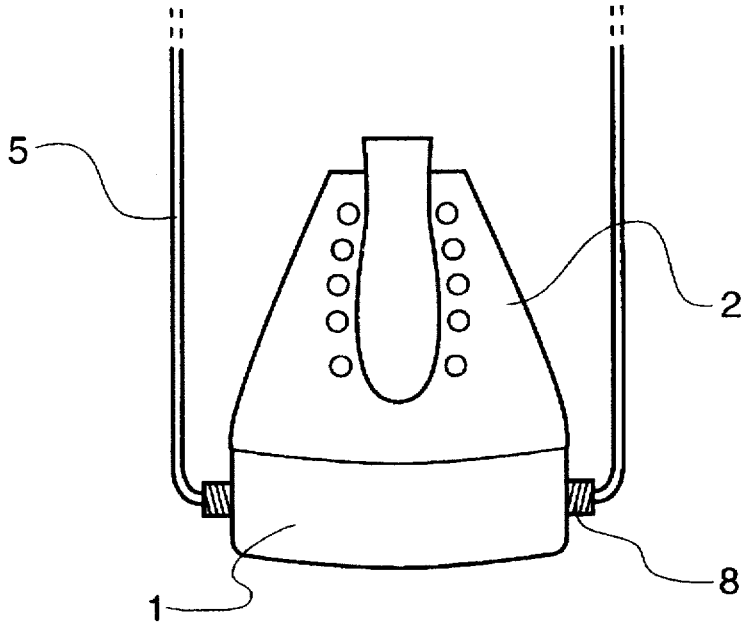
FIG. 3 shows an alternative embodiment of the shoe according to the invention fitted with an elastic cord.

An alternative embodiment of the invention is shown in FIG. 3. In this embodiment, the elastic cord 5 is provided at each end with a screw-threaded connector 8, and the ends of the hole 3 are provided with a complementary thread into which the connectors 8 may be screwed so &s to ensure a secure attachment. In this embodiment it is not necessary for a hole to extend throughout the width of the sole 1; it is sufficient that an anchorage point is provided on either side of the sole. Preferably, however, a relatively rigid member (not shown) corresponding to the tube 4 is provided within the sole so as to connect the anchorage points thereby avoiding undue flexing of the sole 1 when the elastic cord 5 is stretched.

Figure 4:
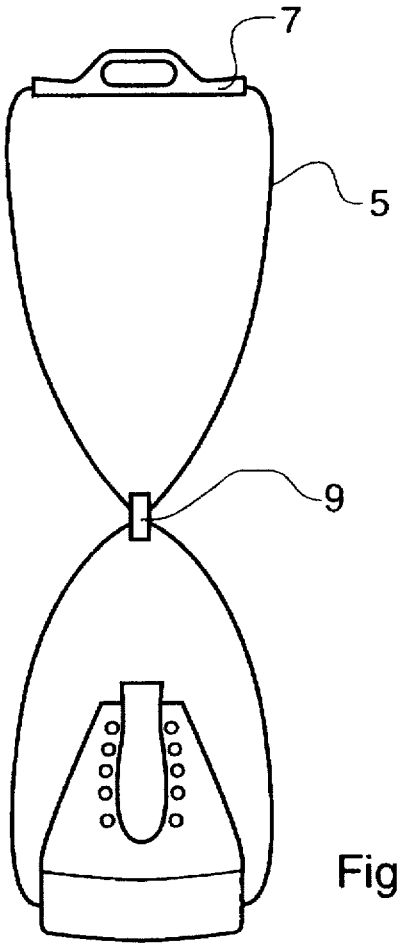
FIG. 4 shows the shoe and cord of FIG. 2 provided with a sliding clip.

FIG. 4 shows how the resistance offered by the cord 5 may be varied by applying a half twist to the loop formed by the cord 5 and securing the cross-over point with a slidable clip 9. By raising and lowering the clip 9, the resistance offered by the cord 5 is respectively decreased and increased.

I claim:

1. An exercise device comprising at least one shoe and at least one elongate elastic member, the at least one shoe including an upper and a sole portion, wherein the sole portion is provided with anchorage means, and wherein the at least one elongate elastic member may be attached to the anchorage means and, in use, gripped by a wearer of the device so as to provide an elastic force against which the wearer may exert him or herself.

2. A device as claimed in claim 1, wherein the anchorage means comprises a hole extending across the width of the sole portion and wherein the at least one elongate elastic member is anchored by being passed through the hole.

3. A device as claimed in claim 2, wherein the hole is lined with a tube which is relatively rigid in comparison to the sole portion.

4. A device as claimed in claim 1, wherein the anchorage means comprises anchorage points provided on generally opposite sides of the sole portion, the anchorage points being adapted securely to receive a connector mounted on an end of an elastic member.

5. A device as claimed in claim 4, wherein the anchorage points are connected to each other by a rigid member passing through the sole portion.

6. A device as claimed in claim 4 wherein the anchorage point and he connector are provided with complementary screw-threads.

7. A device as claimed in claim 2, further provided with detachable caps adapted to be fitted over the ends of the hole or the over the anchorage points.

8. A device as claimed in any claim 1, wherein the at least one elastic member comprises at least one elastic cord in the form of a loop.

9. A device as claimed in claim 8, wherein the limbs of the loop are joined together by a slidable clip.

10. An exercise device comprising at least one shoe and at least one elongate elastic member, the at least one shoe including an upper and a sole portion, wherein the sole portion is provided with anchorage means, and wherein the at least one elongate elastic member may be attached to the anchorage means and, in use, gripped by a wearer of the device so as to provide an elastic force against which the wearer may exert him or herself;

said anchorage means comprising anchorage points provided on generally opposite sides of the sole portion, the anchorage points being adapted securely to receive a connector mounted on an end of an elastic member; and said at least one elastic member comprising at least one or more elastic cords in the form of a loop.

* * * * *